US010488073B2

(12) United States Patent
Wang et al.

(10) Patent No.: US 10,488,073 B2
(45) Date of Patent: Nov. 26, 2019

(54) AIR CONDITIONER

(71) Applicant: GD MIDEA AIR-CONDITIONING EQUIPMENT CO., LTD., Foshan (CN)

(72) Inventors: Quanjie Wang, Foshan (CN); Zixiong Chen, Foshan (CN); Mingkun Ye, Foshan (CN); Xiaojing Wang, Foshan (CN); Zhenqin Ji, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 264 days.

(21) Appl. No.: 15/539,813

(22) PCT Filed: Dec. 31, 2014

(86) PCT No.: PCT/CN2014/095993
§ 371 (c)(1),
(2) Date: Jun. 26, 2017

(87) PCT Pub. No.: WO2016/106723
PCT Pub. Date: Jul. 7, 2016

(65) Prior Publication Data

US 2017/0370607 A1 Dec. 28, 2017

(51) Int. Cl.
*G01K 13/00* (2006.01)
*F24F 11/89* (2018.01)
(Continued)

(52) U.S. Cl.
CPC ..... *F24F 11/89* (2018.01); *F24F 1/0007* (2013.01); *F24F 1/0057* (2019.02); *F24F 11/30* (2018.01); *F24F 13/20* (2013.01); *F24F 2110/10* (2018.01)

(58) Field of Classification Search
CPC ..... F24F 11/89; F24F 11/30; F24F 1/0057; F24F 1/0007; F24F 13/20; F24F 2110/10
(Continued)

(56) References Cited

U.S. PATENT DOCUMENTS 5,485,954 A * 1/1996 Guy ..... G05D 23/1904 236/78 R
6,293,118 B1 9/2001 Oh
(Continued)

FOREIGN PATENT DOCUMENTS

CN 1335922 A 2/2002
CN 101004275 A 7/2007
(Continued)

OTHER PUBLICATIONS

Japanese Patent Application No. 2017523254, Office Action dated Mar. 13, 2018, 5 pages.
(Continued)

*Primary Examiner* — Claire E Rojohn, III
(74) *Attorney, Agent, or Firm* — Anova Law Group PLLC

(57) ABSTRACT

An air-conditioner (10) is provided, including a casing (12), an evaporator (14), a front panel (16) and a temperature sensor (18). The casing (12) has an air inlet (120) and an air outlet (122). The evaporator (14) is arranged in the casing (12). The front panel (16) is arranged in front of the casing (12). The temperature sensor (18) is disposed to a back of the front panel (16) and is used for sensing an ambient temperature.

13 Claims, 5 Drawing Sheets

(51) Int. Cl.

| | |
|---|---|
| ***F24F 1/0057*** | (2019.01) |
| ***F24F 13/20*** | (2006.01) |
| ***F24F 11/30*** | (2018.01) |
| ***F24F 1/0007*** | (2019.01) |
| *F24F 110/10* | (2018.01) |

(58) Field of Classification Search
USPC ..... 165/129
See application file for complete search history.

(56) References Cited

U.S. PATENT DOCUMENTS 6,293,697 B1 * 9/2001 Gul ..... H01H 37/04 174/547
8,197,130 B2 * 6/2012 Wille ..... G01K 1/20 374/138
2012/0137706 A1 * 6/2012 Hussain ..... G06K 19/07749 62/3.6
2012/0260683 A1 * 10/2012 Cheon ..... F25D 29/00 62/125
2014/0360222 A1 * 12/2014 Masui ..... F28F 21/067 62/507
2015/0267929 A1 * 9/2015 Kim ..... F24F 11/30 62/89
2015/0308732 A1 * 10/2015 Lee ..... F25D 21/14 62/291
2016/0010882 A1 * 1/2016 Lee ..... F24F 3/1405 312/228
2016/0040593 A1 * 2/2016 Murai ..... F01P 3/18 165/51
2016/0113417 A1 * 4/2016 Miller ..... G07F 9/105 62/246
2016/0117022 A1 * 4/2016 Kim ..... G06F 3/044 345/174
2018/0023821 A1 * 1/2018 Kim ..... A61L 9/20 62/264
2018/0313591 A1 * 11/2018 Obara ..... F25B 49/02

FOREIGN PATENT DOCUMENTS

CN 202769886 U 3/2013
CN 203083084 U 7/2013
JP 09303911 A * 11/1997
JP H09303911 A 11/1997
JP 2012225574 A * 11/2012
JP 2012225574 A 11/2012

OTHER PUBLICATIONS

Japanese Patent Application No. 2017523254, English translation of Office Action dated Mar. 13, 2018, 5 pages.
PCT/CN2014/095993 International Search Report and Written Opinion dated Sep. 18, 2015, 12 pages.
PCT/CN2014/095993 English translation of International Search Report dated Sep. 18, 2015, 2 pages.
PCT/CN2014/095993 English translation of Written Opinion dated Sep. 18, 2015, 5 pages.
European Patent Application No. 14909530.9 extended Search and Opinion dated Jul. 25, 2018, 9 pages.
The State Intellectual Property Office of PRC (SIPO) The First Office Action For CN Application No. 201480081951.4 Feb. 20, 2019 13 Pages (Translation Included ).

* cited by examiner

AIR CONDITIONER

CROSS REFERENCE TO RELATED APPLICATION

The present application is a U.S. National Phase application under 35 USC § 371 of the International Patent Application No. PCT/CN2014/095993, filed on Dec. 31, 2014. The entire content of the before-mentioned patent application is incorporated by reference as part of the disclosure of this U.S. application.

FIELD

The present disclosure relates to a field of an air conditioner.

BACKGROUND

In a wall-mounted air conditioner, a temperature sensor used for detecting an indoor temperature is disposed close to an air inlet. In the prior art, the temperature sensor is disposed on a surface of an evaporator close to the air inlet. However, as being close to the evaporator, the temperature sensor tends to suffer a thermal radiation of the evaporator, thus causing an apparent difference between an obtained ambient temperature and an actual ambient temperature. In addition, a signal wire connected to the temperature sensor tends to contact and rub fins of the evaporator in the assembling process, which may cause the signal wire to be cut off by the fins, even disable the temperature sensor, and also provide a potential safety risk. In some other cases, the temperature sensor is disposed to a cover plate of an electric motor, which, however, will cause a narrow air inlet channel.

SUMMARY

The present disclosure seeks to solve one of the technical problems in the related art. Thus, the present disclosure needs to provide an air conditioner.

An air conditioner according to embodiments of the present disclosure includes a casing, an evaporator, a front panel and a temperature sensor. The casing has an air inlet and an air outlet. The evaporator is disposed in the casing. The front panel is disposed in front of the casing. The temperature sensor is disposed to a back of the front panel and configured to sense an ambient temperature.

With an air conditioner according to a preferable embodiment of the present disclosure, as the temperature sensor is disposed to the front panel, a value sensed by the temperature sensor is less influenced by the evaporator.

In some embodiments, the temperature sensor is adjacent to the air inlet.

In some embodiments, the air conditioner further includes an electric element cover disposed to the back of the front panel, in which an electric element cavity is defined by the electric element cover and the front panel, the electric element cavity is provided with a vent, and the temperature sensor is provided in the electric element cavity.

In some embodiments, the electric element cover is provided with a grille part configured for defining the vent.

In some embodiments, the grille part is located at a side of the electric element cover adjacent to the air inlet.

In some embodiments, the vent is opposed to the air inlet.

In some embodiments, the electric element cover includes a cover plate, a side wall and a grille housing. The cover plate has an inner surface facing the front panel and an outer surface opposite to the inner surface. The side wall is disposed at an outer circumferential edge of the cover plate, in which a first accommodating cavity, configured to accommodate an electric element and opened over the inner surface of the cover plate, is defined by the side wall and the inner surface of the cover plate. The grille housing is configured as the grille part and protrudes from the outer surface of the cover plate, in which a second accommodating cavity, separated from the first accommodating cavity and opened over a portion of the grille housing protruding from the outer surface of the cover plate, is defined by the grille housing, the cover plate and the side wall, and the temperature sensor is accommodated in the second accommodating cavity.

In some embodiments, the portion of the grille housing protruding from the outer surface of the cover plate includes a first end, a second end and a plurality of half-annular grids located between the first end and the second end and spaced apart from one another, the first end has a shape of a quarter of spherical shell, and the second end has a half-annular shape and is provided with an end grid in an outer end surface of the second end.

In some embodiments, the air conditioner further includes a housing cover pivotably mounted to the grille housing and configured to open and close the second accommodating cavity.

In some embodiments, the grille housing is provided with a first snap base and the housing cover is provided with a first snap hook configured to be engaged with the first snap base.

In some embodiments, an elastic pressing rib configured to tightly press the temperature sensor in the second accommodating cavity is provided on a surface of the housing cover.

In some embodiments, a stand is provided in the back of the front panel and the electric element cover is detachably connected to the stand so as to define the electric element cavity together with the stand.

In some embodiments, the stand is provided with a second snap base and the electric element cover is provided with a second snap hook configured to be engaged with the second snap base.

In some embodiments, the front panel is provided with a recess in the back thereof and the stand is disposed in the recess.

In some embodiments, the stand is detachably engaged in the recess.

In some embodiments, the electric element cover is provided with a hand-clasping portion configured for detaching the electric element cover from the stand.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
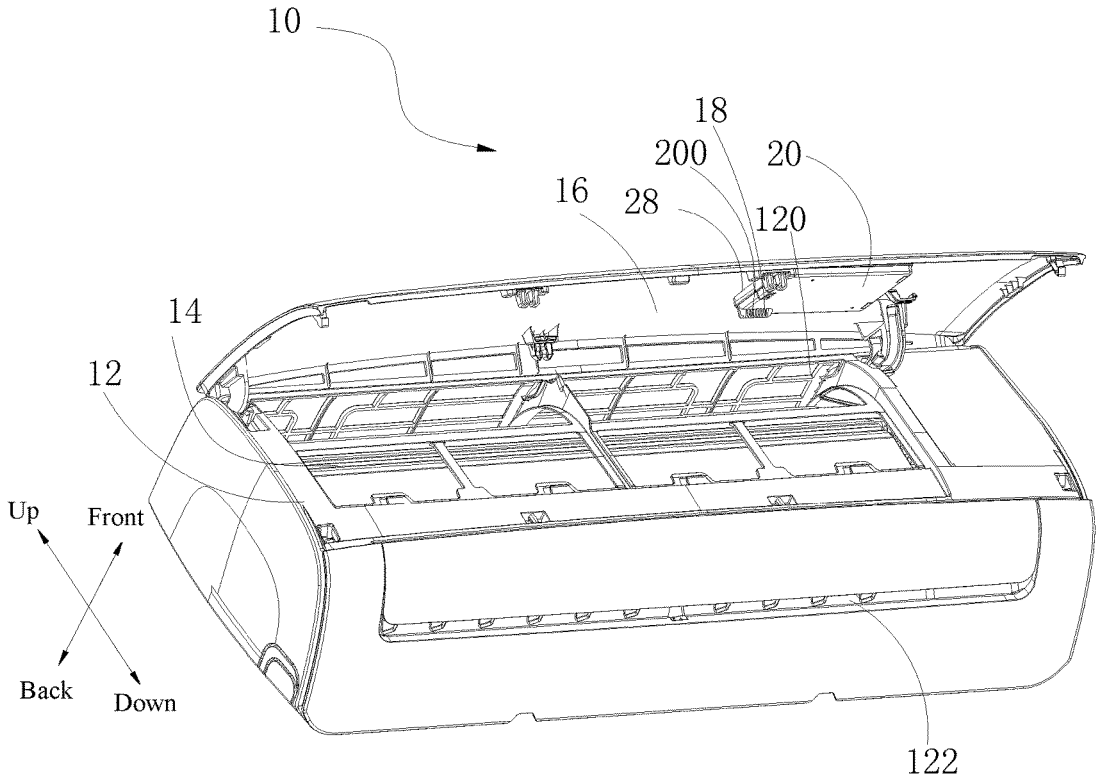
FIG. 1 is a perspective view of an air conditioner according to a preferable embodiment of the present disclosure.
Figure 2:
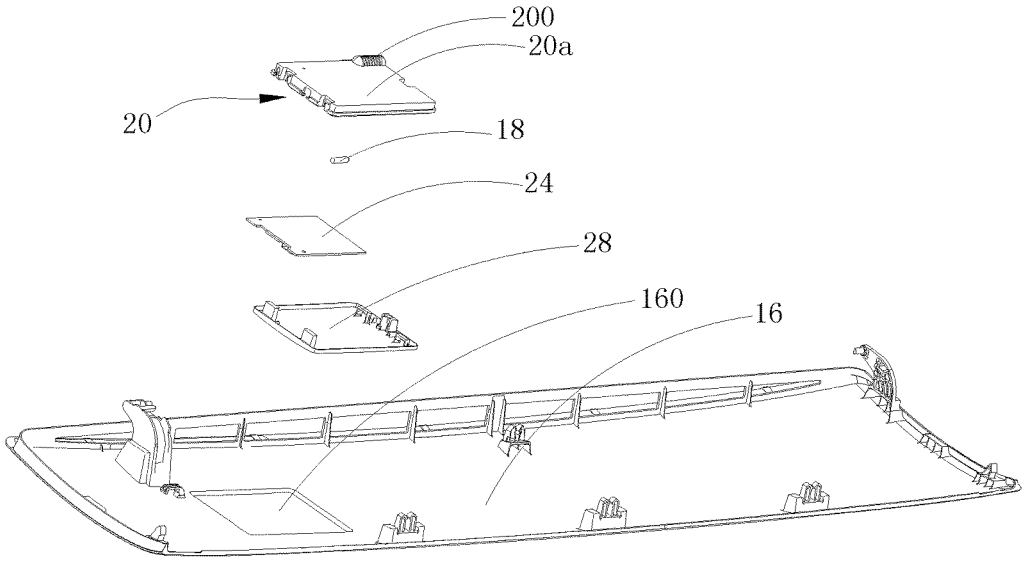
FIG. 2 is a partial exploded view of an air conditioner according to a preferable embodiment of the present disclosure.
Figure 3:
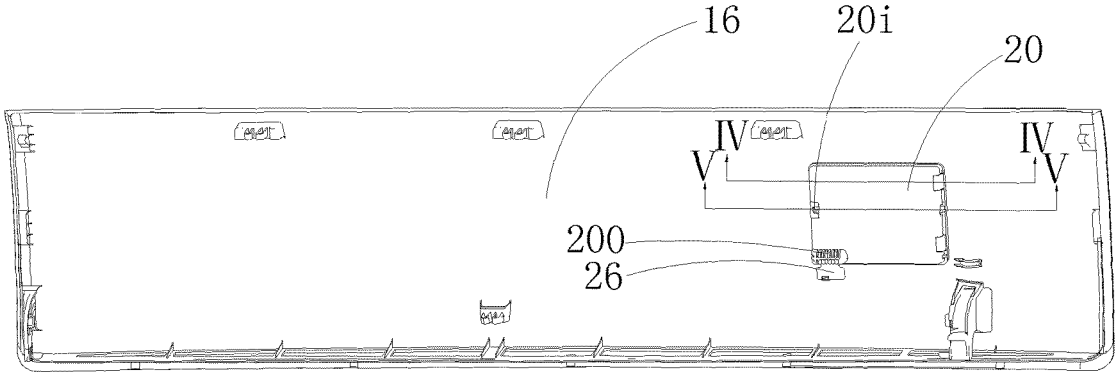
FIG. 3 is a schematic plan of a front panel of an air conditioner according to a preferable embodiment of the present disclosure.
Figure 4:
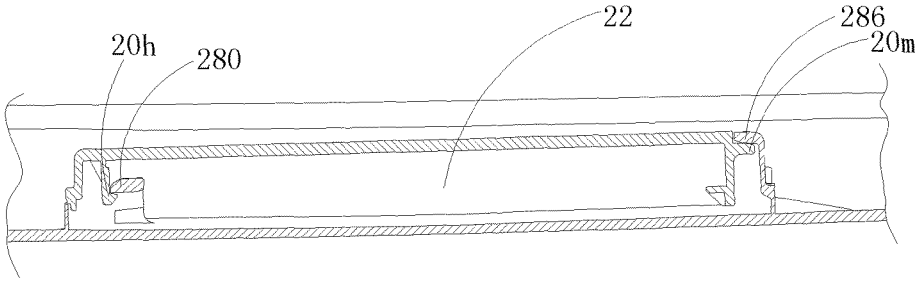
FIG. 4 is a section view of the air conditioner in FIG. 3 along IV-IV.
Figure 5:
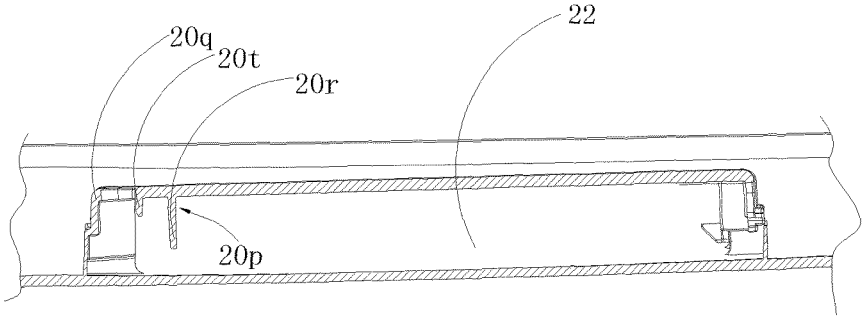
FIG. 5 is a section view of the air conditioner in FIG. 3 along V-V.

Embodiments of the present disclosure will be described in detail in the following. Examples of the embodiments are shown in the drawings, and the same or similar elements and the elements having same or similar functions are denoted by like reference numerals throughout the descriptions. The embodiments described with reference to the drawings are illustrative, which is only used to explain the present disclosure and shouldn't be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure be constructed or operated in a particular orientation, thus cannot be construed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, it is to be illustrated, unless specified or limited otherwise, the terms "mounted," "connected," "coupled" should be understood broadly, and may be, for example, fixed connections, detachable connections, or integral connections; may also be mechanical or electrical connections or able to communication with each other; may also be direct connections or indirect connections via intervening structures; may also be inner communications or interaction relation of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

With reference to FIG. 1, an air conditioner 10 according to a preferable embodiment of the present disclosure includes a casing 12, an evaporator 14, a front panel 16 and a temperature sensor 18. The casing 12 has an air inlet 120 and an air outlet 122. The evaporator 14 is disposed within the casing 12. The front panel 16 is disposed in front of the casing 12. The temperature sensor 18 is disposed to a back of the front panel 16 and configured to sense an ambient temperature.

With the air conditioner 10 according to the preferable embodiment of the present disclosure, as the temperature sensor 18 is disposed to the front panel 16, a value sensed by the temperature sensor 18 is less influenced by the evaporator 14. Specifically, the casing 12 has a rectangular box shape. The evaporator 14 is accommodated in the casing 12. The casing 12 is provided with the air inlet 120 configured to expose the evaporator 14 and the air outlet 122 used for air output. The front panel 16 has a rectangular shape and is rotatably disposed in front of the casing 12. The front panel 16 is configured to close the casing 12. The air inlet 120 has a substantially rectangular shape, located in an upper-end surface of the casing 12 of the air conditioner 10, and occupies a main portion of the upper-end surface of the casing 12. The air outlet 122 has a substantially rectangular shape, located in a lower-end surface of the casing 12 of the air conditioner 10, and occupies a main portion of the lower-end surface of the casing 12.

In the present embodiment, the temperature sensor 18 is adjacent to the air inlet 120.

Thus, an accuracy of measurement of the temperature sensor 18 can be improved.

Specifically, when the front panel 16 closes the casing 12, the temperature sensor 18 is adjacent to the air inlet 120, so the accuracy of measurement of the temperature sensor 18 is guaranteed.

With reference to FIG. 2 to FIG. 5, in the present embodiment, the air conditioner 10 further includes an electric element cover 20 disposed to the back of the front panel 16, and an electric element cavity 22 is formed between the electric element cover 20 and the front panel 16. The electric element cavity 22 is provided with a vent 220, and the temperature sensor 18 is provided in the electric element cavity 22.

Thus, by providing the electric element cover 20, the temperature sensor 18 is further less influenced by the evaporator 14.

Specifically, the electric element cover 20 has a rectangular shape, and a rectangular electric element cavity 22 is formed between the electric element cover 20 and the front panel 16. The temperature sensor 18 is disposed in the electric element cavity 22 and adjacent to the vent 220.

In the present embodiment, the electric element cover 20 is provided with a grille part 200 configured to define the vent 220.

Thus, the temperature sensor 18 can communicate with an outer environment via the vent 220 of the grille part 200, so as to sense the ambient temperature better.

In the present embodiment, the grille part 200 is located at a side of the electric element cover 20 adjacent to the air inlet 120.

Thus, the grille part 200 is arranged adjacent to the air inlet 120, and the accuracy of measurement of the temperature sensor 18 can be improved.

In the present embodiment, the vent 220 is opposed to the air inlet 120.

Thus, the vent 220 is opposed to the air inlet 120, and the accuracy of measurement of the temperature sensor 18 can be improved.

Specifically, the grille part 200 has a substantially tubular shape, and the temperature sensor 18 has a cylindrical shape, arranged along an axial direction of the tubular grille part 200 and accommodated in the grille part 200. The temperature sensor 18 is fitted with the grille part 200 as much as possible in shape and location, so as to increase an area of the temperature sensor 18 communicating with the outer environment, and thus the accuracy of measurement of the temperature sensor 18 can be improved.

Figure 6:
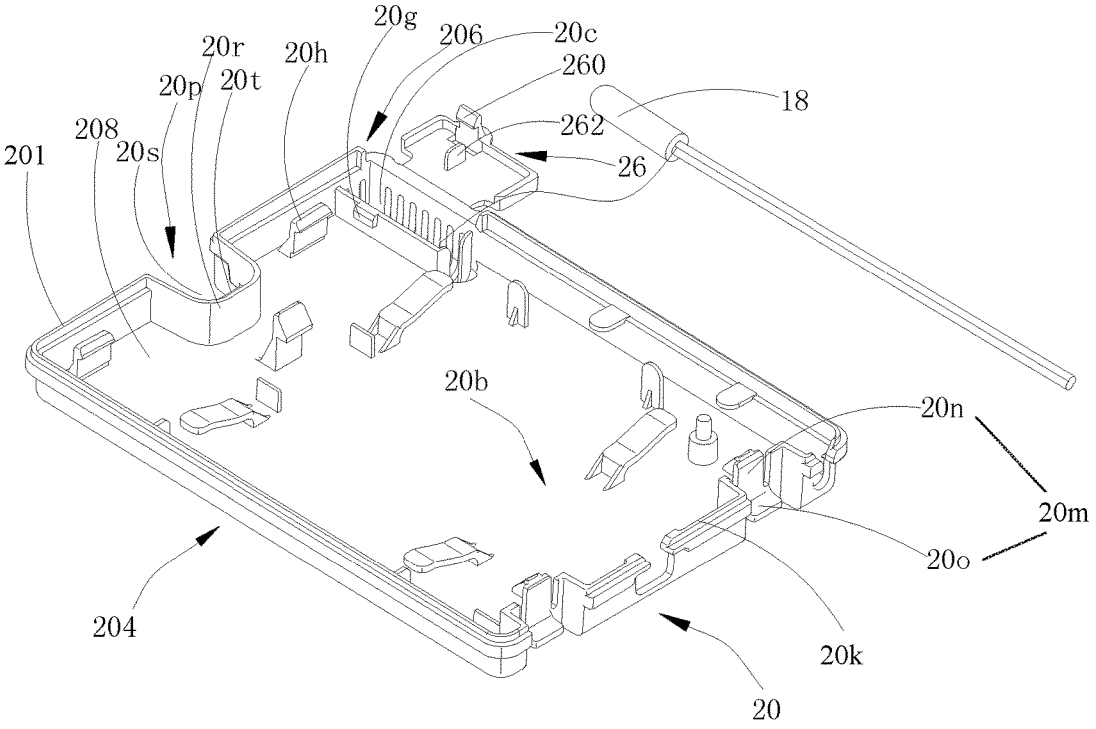
FIG. 6 is a front perspective view of an electric element cover of an air conditioner according to embodiments of the present disclosure.
Figure 7:
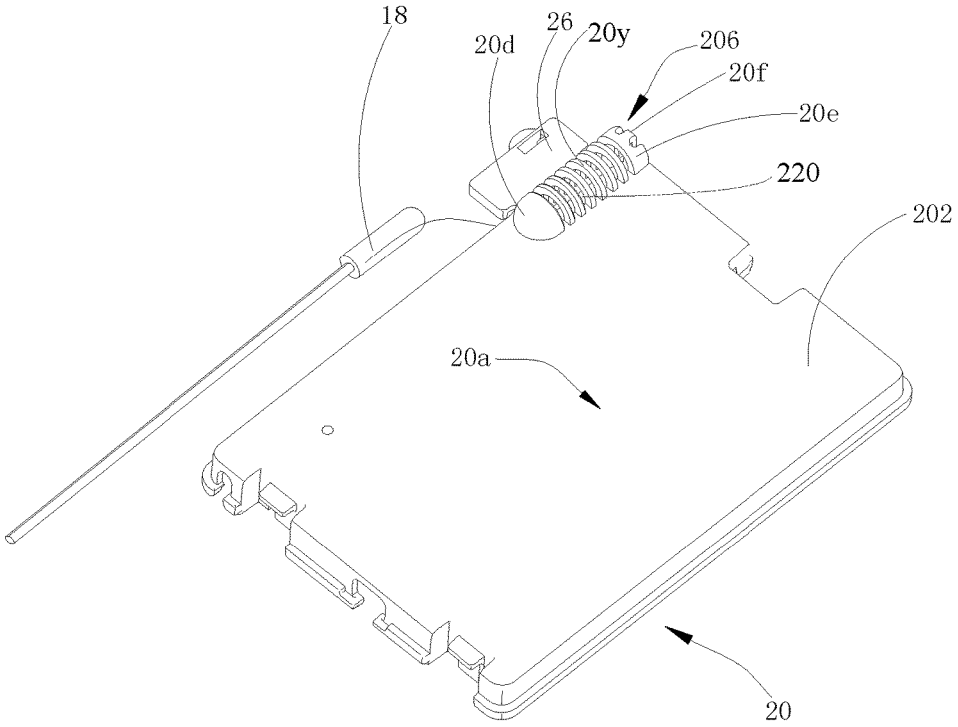
FIG. 7 is a back perspective view of an electric element cover of an air conditioner according to embodiments of the present disclosure.
Figure 8:
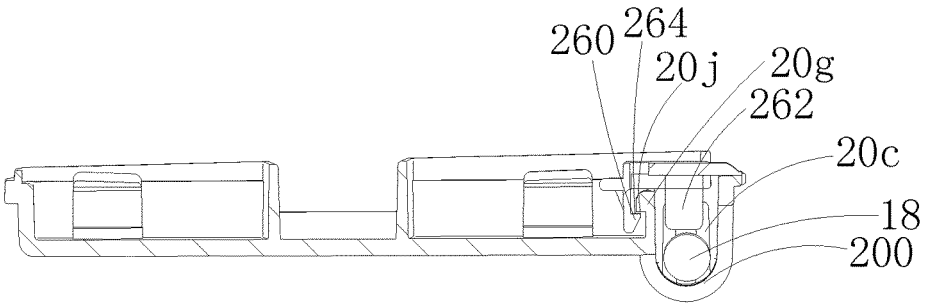
FIG. 8 is an assembling view of a grille part and a housing cover of an electric element cover of an air conditioner according to embodiments of the present disclosure.

With reference to FIG. 6 to FIG. 8, in the present embodiment, the electric element cover 20 includes a cover plate 202, a side wall 204 and a grille housing 206. The cover plate 202 has an inner surface 208 facing the front panel 16 and an outer surface 20*a* opposite to the inner surface 208. The side wall 204 is disposed at an outer circumferential edge of the cover late 202, and a first accommodating cavity 20*b* is defined by the side wall 204 and the inner surface 208 of the cover plate 202. The first accommodating cavity 20*b* is configured to accommodate an electric element 24 and is opened over the inner surface 208 of the cover plate 202. The grille housing 206 forms the grille part 200 and protrudes from the outer surface 20*a* of the cover plate 202. A second accommodating cavity 20*c*, separated from the first accommodating cavity 20*b* and opened over a portion of the grille housing 206 protruding from the outer surface 20*a* of the cover plate 202, is defined by the grille housing 206, the cover plate 202 and the side wall 204, and the temperature sensor 18 is accommodated in the second accommodating cavity 20*c*.

Thus, the temperature sensor 18 is separated from the first accommodating cavity 20*b* configured to accommodate the electric element 24 by means of the second accommodating cavity 20*c*, such that the temperature sensor 18 is not influenced by a heat generation of the electric element 24, and the measurement of the temperature sensor 18 can be more accuracy.

In the present embodiment, the portion of the grille housing 206 protruding from the outer surface 20*a* of the cover plate 202 includes a first end 20*d*, a second end 20*e* and a plurality of half-annular grids 20*y* located between the first end 20*d* and the second end 20*e* and spaced apart from one another. The first end 20*d* has a shape of a quarter of spherical shell, and the second end 20*e* has a half-annular shape and is provided with an end grid 20*f* in an outer-end surface of the second end 20*e*.

Thus, the spaced annular grids 20*y* and the end grid 20*f* can optimize an entry angle of air into the second accommodating cavity 20*c*, so as to allow the air to enter the second accommodating cavity 20*c* from various directions, thereby improving the accuracy of temperature measurement. Specifically, the electric element 24 includes a circuit plate and a light-emitting diode display, the first accommodating cavity 20*b* has a rectangular shape, and the electric element 24 is detachably fixed in the first accommodating cavity 20*b*. The second accommodating cavity 20*c* has a tubular shape and has a size in match with that of the temperature sensor 18. Certainly, the application of the electric element cover 20 is not limited to the present embodiment, and may be also applied to other suitable products or cases.

In the present embodiment, the air conditioner 10 further includes a housing cover 26 pivotably mounted to the grille housing 206 and configured to open and close the second accommodating cavity 20*c* which is opened over the portion of the grille housing 206 protruding from the outer surface 20*a* of the cover plate 202. The housing cover 26 has a rectangular shape and has a size in match with that of the grille part 200.

Thus, the housing cover 26 can fix the temperature sensor 18 in the second accommodating cavity 20*c*, so as to prevent the temperature sensor 18 from dropping out of the grille housing 206 during a movement of the air conditioner 10, thereby protecting the temperature sensor 18.

In the present embodiment, the grille housing 206 is provided with a first snap base 20*g* and the housing cover 26 is provided with a first snap hook 260 configured to be engaged with the first snap base 20*g*.

Thus, with the first snap base 20*g* being engaged with the first snap hook 260, the housing cover 26 is fixed with the grille housing 206, thereby providing a simple structure and results in convenient assembling and disassembling.

Specifically, the first snap base 20*g* is protruded outwards from the grille housing 206 along a direction perpendicular to an axial direction of the grille housing 206, and the first snap base 20*g* has a rectangular shape. The housing cover 26 is correspondingly provided with the first snap hook 260 configured to be engaged with the first snap base 20*g*, and the first snap hook 260 extends upwards from an inner side of the housing cover 26 and protrudes at a top of the first snap hook 260 in a direction perpendicular to an extending direction of the first snap hook 260, specifically towards the first snap base 20*g* as shown in FIG. 6, so as to form a snap-fit surface 264. When the first snap base 20*g* is hooked by the first snap hook 260, a bottom surface 20*j* of the first snap base 20*g* stops the snap-fit surface 264.

In the present embodiment, an elastic pressing rib 262 configured to tightly press the temperature sensor 18 in the second accommodating cavity 20*c* is provided on a surface of the housing cover 26.

Thus, the elastic pressing rib 262 tightly presses the temperature sensor 18 in the second accommodating cavity 20*c*, thereby allowing the temperature sensor 18 to be in better communication and contact with the outer environment, so as to sense the ambient temperature more precisely.

Figure 9:
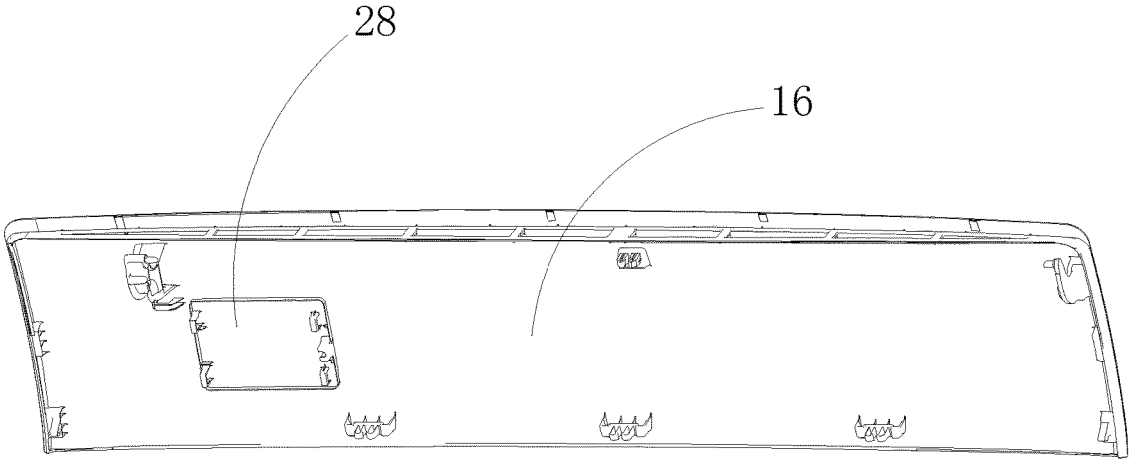
FIG. 9 is a perspective view of a front panel of an air conditioner according to embodiments of the present disclosure.

With reference to FIG. 9, in the present embodiment, a stand 28 is provided in the back of the front panel 16 and the electric element cover 20 is detachably connected to the stand 28 so as to define the electric element cavity 22 together with the stand 28.

Thus, with the electric element cover 20 being fitted with and mounted to the detachable stand 28, the temperature sensor 18 is fixed to the back of the front panel 16, thereby providing a simple structure, causing convenient assembling and disassembling, as well as easy maintenance.

Figure 10:
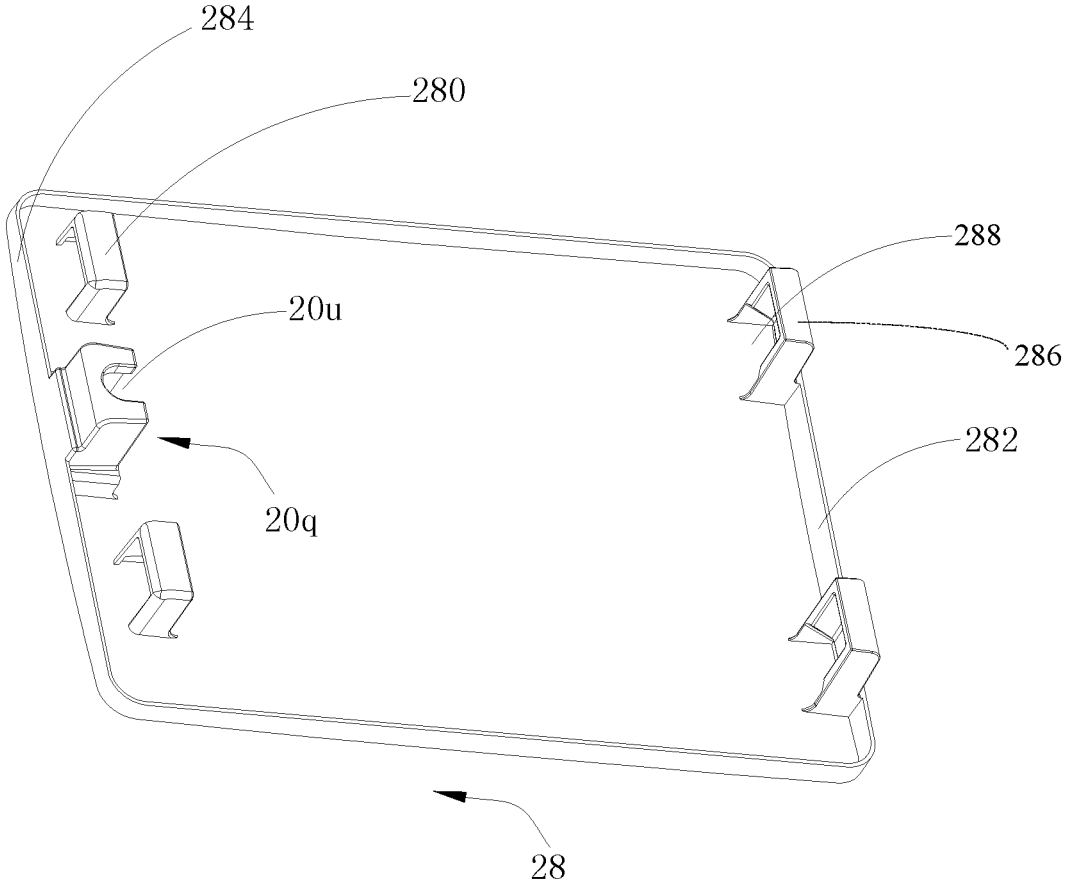
FIG. 10 is a perspective view of a stand of an air conditioner according to embodiments of the present disclosure.

With reference to FIG. 10, in the present embodiment, the stand 28 is provided with a second snap base 280 and the electric element cover 20 is provided with a second snap hook 20*h* configured to be engaged with the second snap base 280.

Thus, with the second snap base 280 being engaged with the second snap hook 20*h*, the stand 28 is fixed with the electric element cover 20, thereby providing a simple structure and causing convenient assembling and disassembling.

Specifically, the stand 28 includes a first side 282 and a second side 284 opposed to the first side 282. The electric element cover 20 includes a third side 20*k* corresponding to the first side 282 and a fourth side 201 corresponding to the second side 284. The stand 28 is further provided with a pin receptacle 286, and the electric element cover 20 is provided with a pin assembly 20*m* correspondingly. Two pin receptacles 286 are provided and distributed at two ends of the first side 282 along the first side 282. Two second snap bases 280 are provided and distributed at two ends of the second side 284 along the second side 284. Two pin assemblies 20*m* are provided and distributed at two ends of the third side 20*k* along the third side 20*k*. Two second snap hooks 20*h* are provided and distributed at two ends of the fourth side 201 along the fourth side 201.

The pin receptacle 286 is provided with a pin hole 288 configured as a substantially rectangular blind hole. The second snap base 280 is provided with a through hole having a substantially rectangular shape. The pin assembly 20*m* includes a connecting sheet 20*n* extending upwards from the inner surface 208 and an inserting sheet 20*o* extending from a lower end of the connecting sheet 20*n* towards the third side 20*k*, and the inserting sheet 20*o* is configured to be inserted to the pin hole 288.

When the electric element cover 20 is mounted to the stand 28, the inserting sheet 20*o* is obliquely inserted into the pin hole 288, and then the electric element cover 20 is pressed down at a position close to the fourth side 201 of the electric element cover 20, such that the second snap hook 20*h* is fastened with the second snap base 280 via snap fit, thus realizing the assembling of the stand 28 and the electric element cover 20 in an "inside fastened fixing" manner. Relative to a traditional "outside fastened fixing" manner in which a screw is used, the air conditioner 10 is more convenient to be assembled and has a complete and beautiful appearance. In the present embodiment, the front panel 16 is provided with a recess 160 in the back thereof and the stand 28 is disposed in the recess 160. The shape and size of the recess 160 are matched with those of the stand 28.

Thus, the stand 28 is disposed in the recess 160 of the front panel 16, such that the space in the air conditioner 10 is reasonably used, and the stand 28 and the electric element cover 20 fixed to the stand 28 will not block the air inlet 120.

In the present embodiment, the stand 28 is detachably engaged in the recess 160.

Thus, the simple structure is provided and the convenient assembling and disassembling are achieved.

In the present embodiment, the electric element cover 20 is provided with a hand-clasping portion 20*i* configured for detaching the electric element cover 20 from the stand 28.

Thus, it is convenient to detach the electric element cover 20 from the stand 28.

Specifically, the hand-clasping portion 20*i* includes a prising piece 20*p* and a supporting piece 20*q*. The prising piece 20*p* is disposed in the electric element cover 20 and close to the second snap-hook 20*h*, and the supporting piece 20*q* is disposed in the stand 28 and close to the second snap-base 280. The prising piece 20*p* includes a U-shaped arc surface 20*r* close to the second snap-hook 20*h* and recessed inwards from the fourth side 201, a fitting hole 20*s* located in the U-shaped arc surface 20*r* and configured to accommodate the supporting piece 20*q* exactly, and a prising plate 20*t* extending upwards from the inner surface 208 and lower than the U-shaped arc surface 20*r*, in which the prising plate 20*t* is located between the fitting hole 20*s* and the U-shaped arc surface 20*r*. The supporting piece 20*q* has a substantially rectangular shape and is provided with a U-shaped hole 20*u*. Preferably, the prising piece 20*p* is located in middle of two groups of the second snap hook 20*h* and the second snap base 280. With the hand-clasping portion 20*i*, it is convenient to prise the second snap hook 20*h* up from the second snap base 280, so it is convenient for the detachment of the electric element cover 20.

Reference throughout this specification to "an embodiment," "some embodiments," "illustrative embodiment", "an example," "a specific example," or "some examples," means that a particular feature, structure, material, or characteristic described in connection with the embodiment or example is included in at least one embodiment or example of the present disclosure. In the present specification, the illustrative statement of the terms above is not necessarily referring to the same embodiment or example. Furthermore, the particular features, structures, materials, or characteristics may be combined in any suitable manner in one or more embodiments or examples.

Although explanatory embodiments have been shown and described, it would be appreciated by those skilled in the art that variations, changes, alternatives, and modifications can be made in the embodiments without departing from principles and sprit of the present disclosure, the scope of the present disclosure is defined by the claims and its equivalents.

What is claimed is:

1. An air conditioner, comprising:

a casing having an air inlet and an air outlet;

an evaporator disposed in the casing;

a front panel disposed in front of the casing;

a temperature sensor disposed to a back of the front panel and configured to sense an ambient temperature; and an electric element cover disposed at the back of the front panel and including:

a cover plate having an inner surface facing the front panel and an outer surface opposite to the inner surface;

a side wall disposed at an outer circumferential edge of the cover plate, wherein a first accommodating cavity, configured to accommodate an electric element and opened over the inner surface of the cover plate, is defined by the side wall and the inner surface of the cover plate; and a grille housing extending for a distance from the outer surface of the cover plate, wherein a second accommodating cavity, separated from the first accommodating cavity and opened over a portion of the grille housing extending for the distance from the outer surface of the cover plate, is defined by the grille housing, the cover plate, and the side wall;

wherein the temperature sensor is accommodated in the second accommodating cavity.

2. The air conditioner according to claim 1, wherein the temperature sensor is adjacent to the air inlet.

3. The air conditioner according to claim 1, wherein the grille housing is located at a side of the electric element cover adjacent to the air inlet.

4. The air conditioner according to claim 3, wherein the grille housing defines a vent that is opposed to the air inlet.

5. The air conditioner according to claim 1, wherein the portion of the grille housing extending for the distance from the outer surface of the cover plate comprises a first end, a second end, and a plurality of half-annular grids located between the first end and the second end and spaced apart from one another, the first end has a shape of a quarter of spherical shell, and the second end has a half-annular shape and is provided with an end grid in an outer end surface of the second end.

6. The air conditioner according to claim 1, further comprising a housing cover pivotably mounted to the grille housing and configured to open and close the second accommodating cavity.

7. The air conditioner according to claim 6, wherein the grille housing is provided with a first snap base and the housing cover is provided with a first snap hook configured to be engaged with the first snap base.

8. The air conditioner according to claim 7, wherein an elastic pressing rib configured to tightly press the temperature sensor in the second accommodating cavity is provided on a surface of the housing cover.

9. The air conditioner according to claim 1, wherein a stand is provided in the back of the front panel and the electric element cover is detachably connected to the stand so as to define an electric element cavity together with the stand.

10. The air conditioner according to claim 9, wherein the stand is provided with a second snap base and the electric element cover is provided with a second snap hook configured to be engaged with the second snap base.

11. The air conditioner according to claim 9, wherein the front panel is provided with a recess in the back thereof and the stand is disposed in the recess.

12. The air conditioner according to claim 11, wherein the stand is detachably engaged in the recess.

13. The air conditioner according to claim 9, wherein the electric element cover is provided with a hand-clasping portion configured for detaching the electric element cover from the stand.

* * * * *